US007722344B2

(12) United States Patent
Morris

(10) Patent No.: US 7,722,344 B2
(45) Date of Patent: May 25, 2010

(54) IMPELLER-DRIVE SHAFT CONSTRUCTION FOR A FUEL PUMP

(75) Inventor: R. David Morris, Fairfield, IL (US)

(73) Assignee: Airtex Products, LLC, Fairfield, IL (US)

( * ) Notice: Subject to any disclaimer, the term of this patent is extended or adjusted under 35 U.S.C. 154(b) by 814 days.

(21) Appl. No.: 11/560,103

(22) Filed: Nov. 15, 2006

(65) Prior Publication Data

US 2008/0112821 A1 May 15, 2008

(51) Int. Cl.
*F01C 21/10* (2006.01)
*F03C 2/00* (2006.01)
*F03C 4/00* (2006.01)

(52) U.S. Cl. ..... 418/150; 418/182; 418/225; 464/182; 403/383

(58) Field of Classification Search ..... 418/181, 418/182, 225–227, 150; 464/182; 403/383
See application file for complete search history.

(56) References Cited

U.S. PATENT DOCUMENTS 2,049,289 A * 7/1936 Burns et al. ..... 464/182
3,151,567 A * 10/1964 Lawrence ..... 418/225
3,304,796 A * 2/1967 Leege ..... 403/383
3,853,435 A 12/1974 Ogasahara et al.
4,209,284 A 6/1980 Lochmann et al.
4,629,399 A 12/1986 Friebe
4,662,827 A 5/1987 Wiernicki
4,948,346 A 8/1990 Tuckey
5,165,881 A * 11/1992 Wicen ..... 403/383
5,755,562 A 5/1998 Novacek et al.
5,947,699 A 9/1999 Cooke
6,709,234 B2 * 3/2004 Gilbert et al. ..... 403/383

FOREIGN PATENT DOCUMENTS

JP 59196986 A * 11/1984

* cited by examiner

*Primary Examiner*—Theresa Trieu
(74) *Attorney, Agent, or Firm*—Polster, Lieder Woodruff & Lucchesi, LC

(57) ABSTRACT

A fuel pump (10) supplying fuel to an internal combustion engine includes an electric motor (14), a shaft (16) driven by the motor, and a pump assembly (18) including a pumping element (20) mounted on the shaft. A fuel pump improvement includes the shaft being a multi-sided shaft with the pumping element having a central opening (22) through which the shaft extends. This opening is a contoured opening having a plurality of sides each of which is in contact with a side (22a-22c) of the shaft to distribute wear which occurs between the shaft and the pumping element. This construction prolongs the operating life of the pump. In a roller vane type pump having N vanes, the motor shaft has a number of sides S determined by the formula S=N±1, and N>3.

16 Claims, 4 Drawing Sheets

IMPELLER-DRIVE SHAFT CONSTRUCTION FOR A FUEL PUMP

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

This invention relates to electric fuel pumps for use in automotive vehicles; and more particularly, to an improved construction for mounting an impeller to a drive shaft by which an electric motor driving the pump causes the impeller assembly of the pump to rotate, the improved construction reducing shaft wear and improving service life of the pump.

A high-pressure electric fuel pump such as is commonly used in fuel injected automobile engines includes a housing in which is encased an electric motor and an impeller assembly driven by the motor. The impeller assembly is mounted on a drive shaft driven by the motor, with the suction created drawing low-pressure fuel into the pump from a fuel tank or reservoir of a fuel module. The impeller is designed to increase the fuel pressure from approximately atmospheric pressure on the input side of the pump to pressures ranging to 50 psi and higher on the outlet side of the pump, depending upon the particular application.

Heretofore, the drive shaft has generally been a round shaft such as shown in FIG. 1A, although other shaped shafts have been used. U.S. Pat. No. 4,209,284, for example, describes a drive shaft, referred to as a D-shaft (see prior art FIG. 1B), because a portion of the shaft is flattened so that the contour of the shaft, viewed axially, resembles the letter D. In U.S. Pat. Nos. 5,722,815 and 5,711,408 opposite portions of the shaft are flattened to create what is referred to as a "double-D" contour. There are also shaft constructions in which an intermediate or end portion of an otherwise circular shaft is shaped into an X pattern such as shown in U.S. Pat. No. 4,978,282, or a square shape with rounded corners such as shown in U.S. Pat. No. 4,639,202. These latter profiles are for mounting and locking the impeller assembly onto the shaft to improve pump efficiency by reducing the effects of wear between the impeller and motor shaft.

While the various constructions shown in these patents may work for their intended purpose, there are improved impeller constructions by which the impeller assembly is mounted on the shaft and which are less susceptible to wear and further increase the efficiency of the fuel pump.

BRIEF SUMMARY OF THE INVENTION

The present invention is directed to a fuel pump supplying fuel to an internal combustion engine. The pump has an electric motor, a shaft driven by the motor, and a pump assembly including a pumping element mounted on the shaft. An improvement to the fuel pump includes the shaft being a multi-sided shaft with the pumping element having a central opening through which the shaft extends. This opening is a contoured opening having a plurality of sides each pf which is in contact with a side of the shaft to distribute the wear, which occurs between the shaft and the pumping element. This construction prolongs the operating life of the pump.

Depending upon a particular application, the shaft has between 3-8 sides and this construction enables any wear between the shaft and pumping assembly element caused by vibrations and other forces acting on the pump to be better distributed so to reduce the wear. This improved construction not only increases the service life of the pump, but also the operating efficiency of the pump because there is less slippage between the shaft and the impeller mounted on the shaft, as the pump rotates at high speed.

In one pump construction, a roller vane type pump has N vanes. For this pump, the pump shaft has a number of sides S determined by the equation $S=N\pm1$.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings, which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1A:
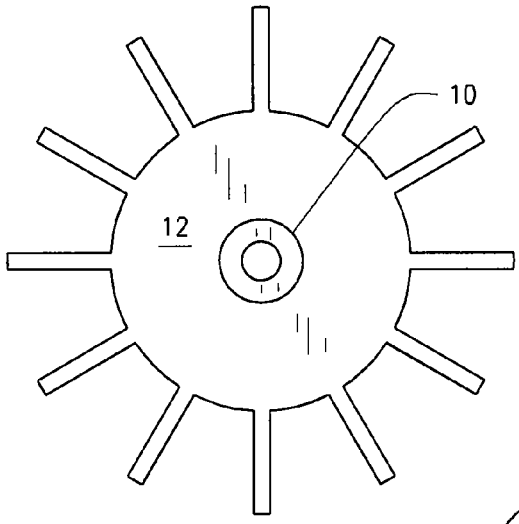
FIG. 1A PRIOR ART
FIGS. 1A and 1B are simplified representations of prior art, shaft/pumping element constructions.
Figure 1B:
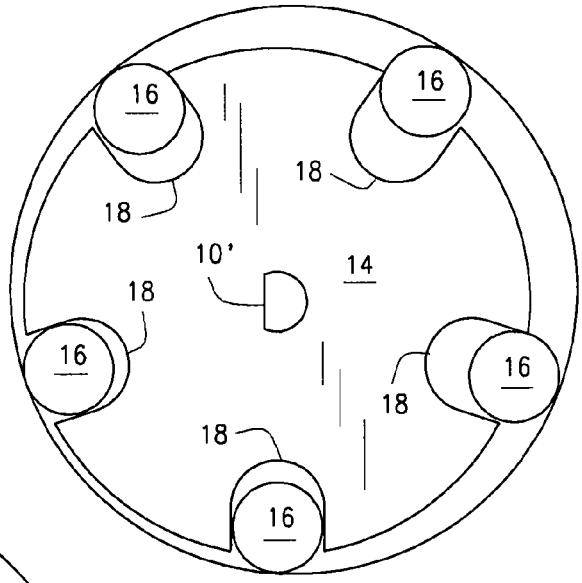
FIG. 1B PRIOR ART

Referring to the drawings, an electric fuel pump for an automotive vehicle includes a motor (not shown) and a drive shaft 10 (FIG. 1A) or 10' (FIG. 1B) rotatably driven by the motor when the pump is operating. A pumping assembly includes a pumping element 12 or 14, which is attached to the shaft and rotates with the shaft. As shown in FIGS. 1A and 1B, one type of pumping element 12 comprises an impeller, while another type of element 14 is for a roller vane pump in which rollers 16 are inserted in vanes 18 formed in the element. Operation of both types of pumps is well-known in the art, and is not described.

As noted above, a persistent problem with existing pump constructions is wear between the pump shaft 10 or 10' and the pumping element 12 or 14 which effectively reduces the useful life of the pump. A fuel pump improvement of the present invention is designed to reduce this wear and thereby increase the pump's useful life. As shown in FIGS. 2-7, the pump shaft is no longer round or D-shaped as shown in the prior art FIGS. 1A and 1B, but is rather is a multi-sided shaft having between 3 and 8 sides in accordance with the invention.

Figure 2:
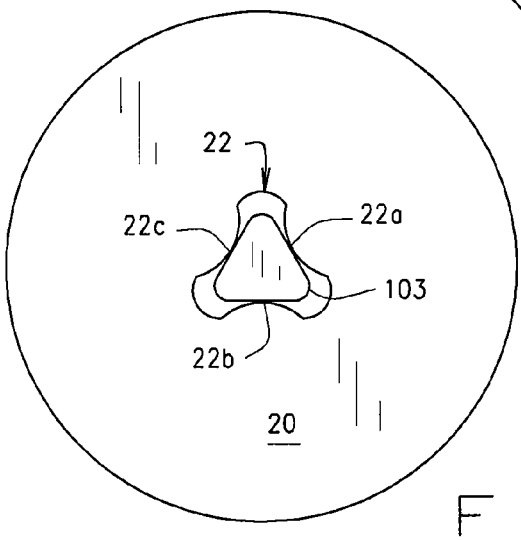
FIGS. 2-7 are plan views of a pumping element/shaft construction in which the shaft has between 3-8 sides, and a central opening in the pumping element has a corresponding number of sides.

In FIG. 2, a motor shaft 103 is shown to be a three-sided shaft of a uniform geometric shape when viewed in cross-section. A pumping assembly element 20 has a central opening 22 which is generally triangular in shape with each side 22*a*-22*c* of the opening having an inwardly curving center section contacting one side of shaft 103. This results in the element 20 having three points of contact with the motor shaft to effectively reduce the wear between the shaft and element 20. The respective corners of the opening 22 are rounded so that the they have a generally lobular shape.

Figure 3:
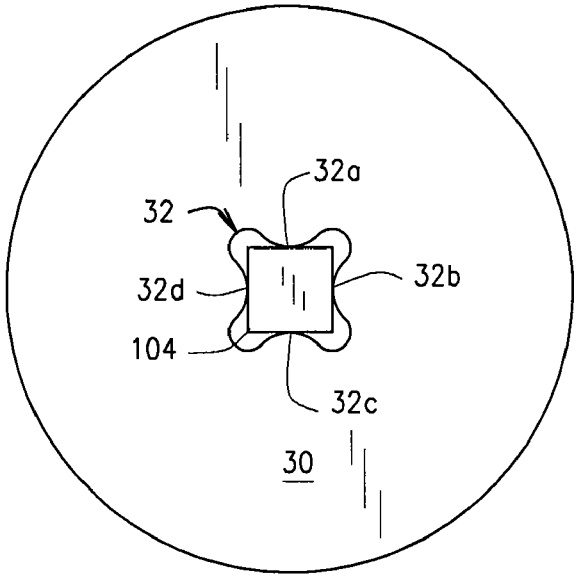

In FIG. 3, a motor shaft 104 is shown to be a four-sided shaft of a generally square geometric shape when viewed in cross-section. A pumping assembly element 30 has a central opening 32 which is also generally square in shape, with rounded corners. Each side 32*a*-32*d* of the opening has an inwardly curving center section contacting one side of shaft 103. Element 30 has four points of contact with motor shaft 104; again, to reduce the wear between the shaft and pumping assembly element.

Figure 4:
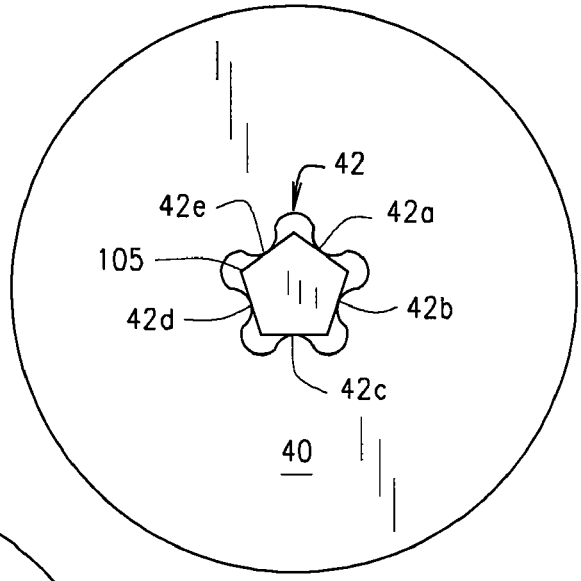

FIG. 4 illustrates a motor shaft 105 which is a five-sided shaft having a generally pentagonal shape when viewed in cross-section. A pumping assembly element 40 has a central opening 42, also generally pentagonal in shape, with rounded corners. Each side 42*a*-42*e* of the opening has an inwardly curving center section contacting one side of shaft 104. Pumping assembly element 40 has five points of contact with shaft 105 so to reduce wear between the shaft and the element.

Figure 5:
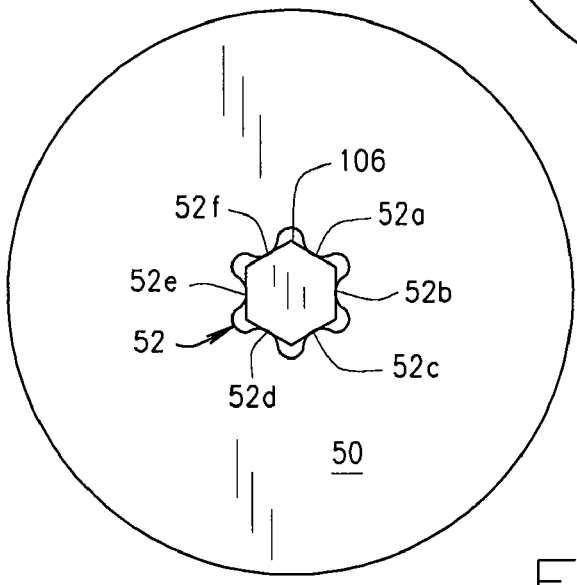

FIG. 5 shows a six-sided generally hexagonally shaped motor shaft 106 on which is installed a pumping assembly element 50. Element 50 has a central, hexagonally shaped opening 52, with rounded corners. Each side 52*a*-52*f* of the opening has an inwardly curving center section contacting one side of shaft 106. The six points of contact between shaft 106 and pumping assembly element 50 again helps reduce wear between the shaft and the element.

Figure 6:
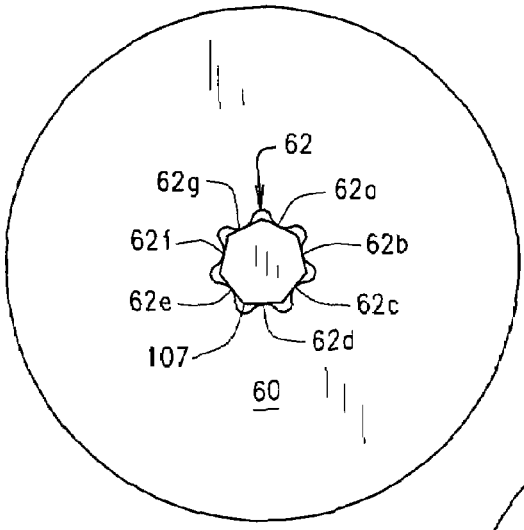

In FIG. 6, a motor shaft 107 is shown to be a seven-sided shaft of a uniform geometric shape when viewed in cross-section. A pumping assembly element 60 has a central opening 62 of a generally seven-sided shape, with rounded corners. Each side 62*a*-62*g* of the opening has an inwardly curving center section contacting one side of shaft 107. This results in element 60 having seven points of contact with shaft 107 to reduce the wear between the shaft and element 60.

Figure 7:
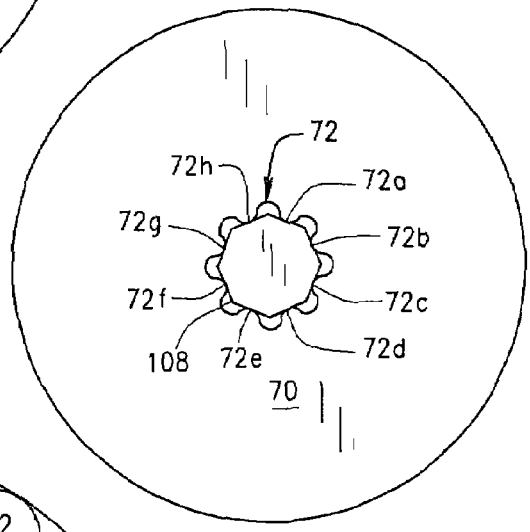

In FIG. 7, a motor shaft 108 is shown to be an eight-sided shaft of a generally octagonal shape as viewed in cross-section. A pumping assembly element 70 has an octagonal central opening 72 with rounded corners, and with each side 72*a*-72*h* of the opening having an inwardly curving center section contacting one side of shaft 108. Element 80 therefore has eight points of contact with motor shaft 108 to reduce the wear between the shaft and pumping assembly element.

Those skilled in the art will appreciate that the motor shaft can have more than eight sides without departing from the scope of the invention. Further, as shown in the drawings, the pumping assembly element attached to the motor shaft has a central opening which is complementary with the shaft. That is, it has the same number of sides as the shaft, and is oriented to the shaft so there is only a point contact between each side of the shaft and the adjoining side of the pumping assembly element defining the opening. Affecting point contact between the shaft and pumping assembly element helps distribute wear between the two. Also, the more sides the shaft has (and correspondingly, the more sides to the opening in the pumping assembly element), the greater the distribution of any wear. The result is a longer service life for the fuel pump and savings in replacement costs.

Figure 8:
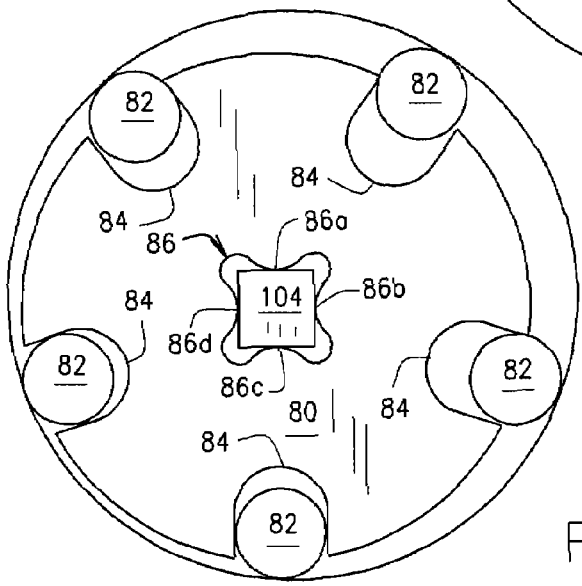
FIG. 8 illustrates one embodiment of the invention with a roller vane pump.

Turning now to FIG. 8, a pumping assembly element 80 is for use in a roller vane fuel pump the operation of which is known in the art, and is not described. The vane pump includes five rollers 82 which are received in pockets 84 formed in element 80 and spaced equidistantly thereabout. In this application, the fuel pump employs the four-sided shaft 104 previously described. Element 80 has a central opening 86 with respective inwardly curving sides 86*a*-86*d*.

Figure 9:
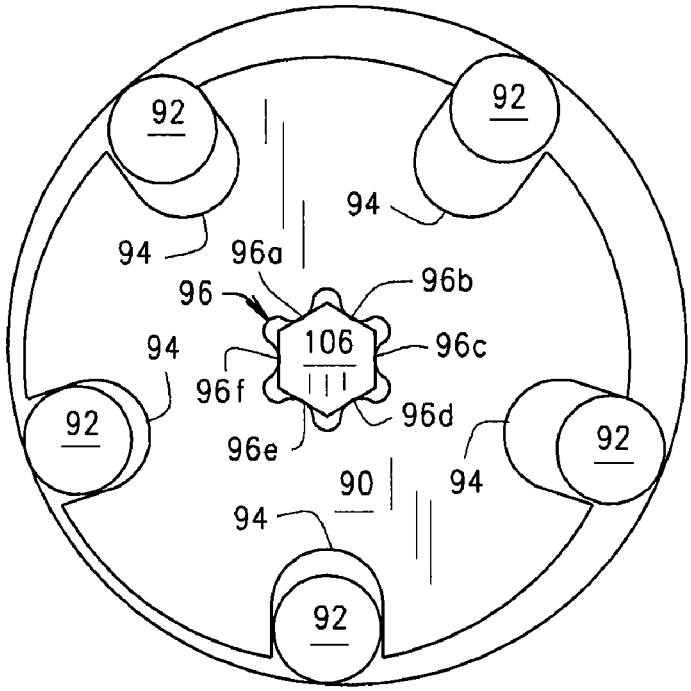
FIG. 9 illustrates a second embodiment of the invention with the roller vane pump; and, FIG. 10 is a plan view of a pump assembly element having a multi-sided insert for use with a corresponding multi-sided shaft.

FIG. 9 also illustrates a pumping element 90 for a roller vane pump having five rollers 92 which are received in pockets 94 formed in element 90 and equidistantly spaced thereabout. Now, the fuel pump employs the six-sided shaft 106 previously described. Element 90 has a central opening 96 with respective inwardly curving sides 96*a*-86*f*.

For the particular pump application shown in FIGS. 8 and 9, it has been found that for a roller vane pump having N number of vanes or rollers, that a pump shaft and corresponding pumping assembly element having one more, or one fewer, sides S than the number of vanes provides a significant improvement in wear over conventional roller vane pump constructions. As a consequence, in designing roller vane pumps, the type of shaft and pumping assembly element which should be used in the fuel pump is determined by the formula $S=N\pm1$.

Figure 10:
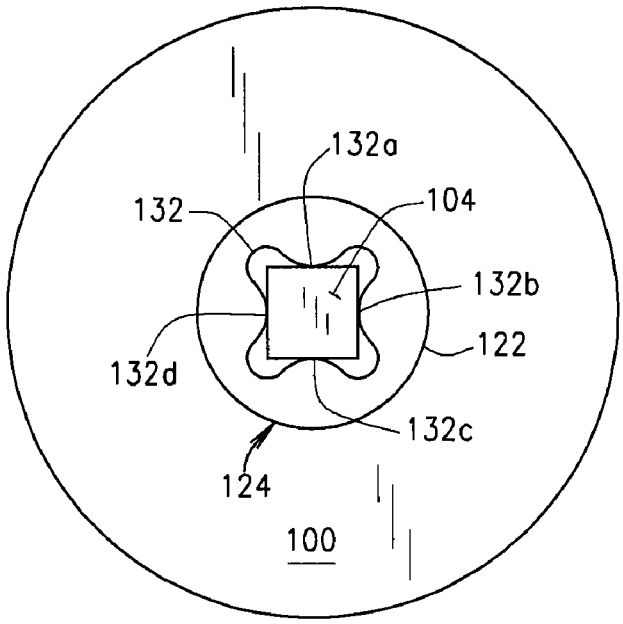

Finally, and as shown in FIG. 10, a pumping assembly element 100 has a central opening 122 in which is received a collar or insert 124 for attaching element 100 to a multi-sided shaft made in accordance with the present invention. In FIG. 10, the shaft is a four-sided shaft 104; although one of the other shafts previously described could be used. Collar 124 insert has a central, four sided opening 132 (with sides 132*a*-132*d*) which is complementary with the shaft 104. Again, if a different shaft were used, an insert with a complementary opening would be used with element 100. An advantage to this embodiment of the invention is that element 100 can be used with any of the multi-sided shafts 103-108 simply by using a different insert with that shaft. This could reduce the costs of the pump since only one pumping assembly element is required.

In view of the above, it will be seen that the several objects and advantages of the present invention have been achieved and other advantageous results have been obtained.

Having thus described the invention, what is claimed and desired to be secured by Letters Patent is:

1. In a roller vane fuel pump for supplying fuel to an internal combustion engine, the pump including an electric motor, a shaft driven by the motor, and a pump assembly including an impeller mounted on the shaft, the improvement wherein the shaft is a multi-sided shaft and the impeller has a central opening through which the shaft extends, the opening being a contoured opening having a plurality of sides each of which are in contact with a side of the shaft to distribute the wear which occurs between the shaft and the impeller thereby to prolong the operating life of the pump, the pump having N vanes and the motor shaft having a number of sides S determined by the formula $S=N\pm1$.

2. The fuel pump improvement of claim 1 in which the shaft has between 3-8 sides.

3. The flow pump improvement of claim 2 in which the shaft has a uniform geometric shape when viewed in cross-section.

4. The fuel pump improvement of claim 3 in which the central opening in the impeller has a geometric shape complementary with that of the shaft.

5. The fuel pump improvement of claim 4 in which each side of the central opening in the impeller contacts a corresponding side of the shaft.

6. The fuel pump improvement of claim 5 in which the contact between the sides of the opening in the impeller and the shaft is a point contact.

7. The fuel pump improvement of claim 6 in which the portion of the impeller defining the sides of the central opening comprise lobular shapes.

8. The fuel pump improvement of claim 5 further including an insert installed in the central opening of the impeller for mounting the impeller on the shaft.

9. The fuel pump improvement of claim 1 in which a coupling has an opening with a geometric shape complementary with that of the shaft for installing the impeller on the shaft.

10. The fuel pump improvement of claim 1 in which the shaft has three sides, is of a uniform geometric shape when viewed in a longitudinal direction, and the central opening in the impeller has a geometric shape complementary with that of the shaft.

11. The fuel pump improvement of claim 1 in which the shaft has four sides, is of a uniform geometric shape when viewed in a longitudinal direction, and the central opening in the impeller has a geometric shape complementary with that of the shaft.

12. The fuel pump improvement of claim 1 in which the shaft has five sides, is of a uniform geometric shape when viewed in a longitudinal direction, and the central opening in the impeller has a geometric shape complementary with that of the shaft.

13. The fuel pump improvement of claim 1 in which the shaft has six sides, is of a uniform geometric shape when viewed in a longitudinal direction, and the central opening in the impeller has a geometric shape complementary with that of the shaft.

14. The fuel pump improvement of claim 1 in which the shaft has seven sides, is of a uniform geometric shape when viewed in a longitudinal direction, and the central opening in the impeller has a geometric shape complementary with that of the shaft.

15. The fuel pump improvement of claim 1 in which the shaft has eight sides, is of a uniform geometric shape when viewed in a longitudinal direction, and the central opening in the impeller has a geometric shape complementary with that of the shaft.

16. In a roller vane fuel pump for supplying fuel to an internal combustion engine, the pump including an electric motor, a shaft driven by the motor, and a pump assembly including an impeller mounted on the shaft, the improvement wherein the shaft is a multi-sided shaft and the impeller has a central opening through which the shaft extends, the opening being a contoured opening having a plurality of sides each of which are in contact with a side of the shaft to distribute the wear which occurs between the shaft and the impeller thereby to prolong the operating life of the pump, the pump having N vanes and the motor shaft having a number of sides S determined by the formula $S=N\pm1$, and in which N is an odd number greater than three.

* * * * *